US005858944A

United States Patent [19]

Keenan et al.

[11] Patent Number: 5,858,944

[45] Date of Patent: Jan. 12, 1999

[54] POLYCARBOXYLATES FOR AUTOMATIC DISHWASHING DETERGENTS

[76] Inventors: Andrea Claudette Keenan, 4027 School House La., Plymouth Meeting, Pa. 19462; Thomas Cleveland Kirk, 861 Sackettsford Rd., Ivyland, Pa. 18974; Thomas Francis McCallum, III, 1333 E. Darby Rd., Havertown, Pa. 19083; Jan Edward Shulman, 8 Hibiscus Pl., Newtown, Pa. 18940; Richard James Tallent, 2196 Joshua Rd., Lafayette Hill, Pa. 19444; Barry Weinstein, 419 Bluebird La., Dresher, Pa. 19025

[21] Appl. No.: 729,885

[22] Filed: Oct. 11, 1996

Related U.S. Application Data

[60] Provisional application No. 60/008,019 Oct. 27, 1995.

[51] Int. Cl.[6] ..... C11D 3/37; C11D 3/10

[52] U.S. Cl. ..... 510/223; 510/337

[58] Field of Search ..... 510/220, 223, 510/222, 221, 337

[56] References Cited

U.S. PATENT DOCUMENTS

| | | | |
|---|---|---|---|
| 4,029,577 | 6/1977 | Godlewski et al. . | |
| 4,647,396 | 3/1987 | Denzinger et al. . | |
| 4,897,215 | 1/1990 | Trieselt et al. . | |
| 4,897,220 | 1/1990 | Clubley et al. . | |
| 4,937,002 | 6/1990 | Bainbridge et al. . | |
| 5,066,749 | 11/1991 | Leighton et al. . | |
| 5,175,361 | 12/1992 | Denzinger et al. . | |
| 5,279,756 | 1/1994 | Savio et al. | 510/230 |
| 5,298,180 | 3/1994 | Dixit | 510/230 |
| 5,308,532 | 5/1994 | Adler et al. | 510/223 |
| 5,545,344 | 8/1996 | Durbut et al. | 510/223 |
| 5,591,703 | 1/1997 | Sadlowski | 510/223 |
| 5,597,509 | 1/1997 | Kirk et al. | 510/223 |

FOREIGN PATENT DOCUMENTS

| | | |
|---|---|---|
| 0075820 | 6/1983 | European Pat. Off. . |
| 0193360 | 3/1986 | European Pat. Off. . |
| 4305396 A1 | 8/1994 | Germany . |

*Primary Examiner*—Margaret Medley
*Attorney, Agent, or Firm*—Ronald S. Hermenau

[57] ABSTRACT

Polycarboxylate additives suitable for use in automatic dishwasher detergent compositions are prepared by polymerizing three or more monomers including monoethylenically unsaturated $C_3$ to $C_6$ monocarboxylic acids such as acrylic acid, monoethylenically unsaturated $C_4$ to $C_6$ dicarboxylic acids such as maleic acid, and monoethylenically unsaturated esters of acrylic or methacrylic acid. Automatic dishwasher detergents prepared from these additives produce low filming and spotting on washed glassware.

16 Claims, No Drawings

POLYCARBOXYLATES FOR AUTOMATIC DISHWASHING DETERGENTS

This is a nonprovisional application of prior pending provisional application Ser. No. 60/008,019, filed Oct. 27, 1995.

This invention relates to polymeric additives for automatic dishwashing detergent (ADD) compositions, and more particularly to polycarboxylate polymeric additives useful in phosphorus-free ADD compositions.

ADD compositions have heretofore been formulated with phosphate builders and chlorine bleaches. Sodium tripolyphosphate has been widely used as a builder because of its multifunctional properties of water sequestration, soil dispersal, soil removal and buffering. Chlorine-containing bleaches remove many stains, e.g., those of coffee and tea, and break down proteinaceous soils into smaller molecules, preventing spot formation on dinnerware and glasses, but chlorine bleaches are incompatible with many desired components of phosphorus-free ADD compositions, such as enzymes, builders and surfactants. Current concern with phosphate in laundry detergents has created market pressure to develop phosphorus-free ADD compositions as well, but such compositions have tended to yield inferior performance. Phosphorus-free builders, such as citrate, carbonate, bicarbonate and silicate builders readily sequester the calcium and magnesium ions responsible for hardness in water, and upon drying leave behind an inorganic "scale" of, for example, calcium carbonate or magnesium silicate, on the surface of glassware, ceramic plates, flatware and internal machine components. This is evidenced as white to bluish-gray film or spots which create an unacceptable appearance for the tableware.

Polymeric additives are desirable in phosphorus-free detergent compositions, because they provide soil dispersancy which would have otherwise come from the phosphorus-containing materials, i.e., phosphates or phosphonates. Many of the polymeric additives are polycarboxylates: copolymers of monocarboxylic acid and dicarboxylic acid monomers, such as those disclosed by Denzinger et al., in U.S. Pat. No. 4,559,159, or of monocarboxylic acid and hydroxyalkyl esters, such as those disclosed by Trieselt et al. in U.S. Pat. No. 4,897,215. These polycarboxylates of the prior art were discloses for use in laundry detergents, and no suggestion exists in either reference that they might provide the required suppression of filming and spotting on glassware when they are used in ADD compositions. A need exists for a polymeric additive that eliminates filming and spotting of glassware for phosphorus-free ADD compositions as effectively as the phosphorus-containing ADD compositions.

We have discovered a polymeric composition suitable for use as a detergent additive which imparts improved film inhibition properties to phosphorus-free ADD compositions. The polymeric composition of the present invention is a copolymer comprising from 40 to 85 mol percent polymerized units of one or more monoethylenically unsaturated $C_3$ to $C_6$ monocarboxylic acids, from 5 to 50 mol percent polymerized units of one or more monoethylenically unsaturated $C_4$ to $C_6$ dicarboxylic acids, and from 10 to 40 mol percent polymerized units of one or more lower-alkyl esters of (meth)acrylic acid, the lower-alkyl groups being unsubstituted and the copolymer having a weight-average molecular weight of from 1000 to 30,000.

We have further discovered a polymeric composition suitable for use as a detergent additive in phosphorus-free ADD compositions which is a copolymer comprising from 40 to 85 mol percent polymerized units of one or more monoethylenically unsaturated $C_3$ to $C_6$ monocarboxylic acids, from 5 to 50 mol percent polymerized units of one or more monoethylenically unsaturated $C_4$ to $C_6$ dicarboxylic acids, and from 10 to 40 mol percent polymerized units of one or more lower-alkyl esters of (meth)acrylic acid, at least one lower-alkyl group being substituted with a hydroxyl group, the copolymer having a weight-average molecular weight of from 1000 to 30,000, and the copolymer being polymerized at pH 2 or less.

We have still further discovered a phosphorus-free automatic dishwashing detergent compositions having improved film inhibition, which comprises from 1 to 20 weight percent of a copolymer comprising from 40 to 85 mol percent polymerized units of one or more monoethylenically unsaturated $C_3$ to $C_6$ monocarboxylic acids, from 5 to 50 mol percent polymerized units of one or more monoethylenically unsaturated $C_4$ to $C_6$ dicarboxylic acids, and from 10 to 40 mol percent polymerized units of one or more lower-alkyl esters of (meth)acrylic acid, the lower-alkyl groups being unsubstituted and the copolymer having a weight-average molecular weight of from 1000 to 30,000.

We have still further discovered a phosphorus-free automatic dishwashing detergent compositions having improved film inhibition, which comprises from 1 to 20 weight percent of a copolymer comprising from 40 to 85 mol percent polymerized units of one or more monoethylenically unsaturated $C_3$ to $C_6$ monocarboxylic acids, from 5 to 50 mol percent polymerized units of one or more monoethylenically unsaturated $C_4$ to $C_6$ dicarboxylic acids, and from 10 to 40 mol percent polymerized units of one or more lower-alkyl esters of (meth)acrylic acid, at least one lower-alkyl group being substituted with a hydroxyl group, the copolymer having a weight-average molecular weight of from 1000 to 30,000, and the copolymer being polymerized at pH 2 or less.

We hare still further discovered a method for reducing film formation on tableware washed in an automatic dishwasher which comprises washing the tableware in the automatic dishwasher with an aqueous mixture of a phosphorus-free automatic-dishwashing detergent containing a copolymer comprising from 40 to 85 mol percent polymerized units of one or more monoethylenically unsaturated $C_3$ to $C_6$ monocarboxylic acids, from 5 to 50 mol percent polymerized units of one or more monoethylenically unsaturated $C_4$ to $C_6$ dicarboxylic acids, and from 10 to 40 mol percent polymerized units of one or more lower-alkyl esters of (meth)acrylic acid, the lower-alkyl groups being unsubstituted and the copolymer having a weight-average molecular weight of from 1000 to 30,000.

We have still further discovered a method for reducing film formation on tableware washed in an automatic dishwasher which comprises washing the tableware in the automatic dishwasher with an aqueous mixture of a phosphorus-free automatic-dishwashing detergent containing a copolymer comprising from 40 to 85 mol percent polymerized units of one or more monoethylenically unsaturated $C_3$ to $C_6$ monocarboxylic acids, from 5 to 50 mol percent polymerized units of one or more monoethylenically unsaturated $C_4$ to $C_6$ dicarboxylic acids, and from 10 to 40 mol percent polymerized units of one or more lower-alkyl esters of (meth)acrylic acid, at least one lower-alkyl group being substituted with a hydroxyl group, the copolymer having a weight-average molecular weight of from 1000 to 30,000, and the copolymer being polymerized at pH 2 or less.

The term "copolymer" as used herein refers to a polymer of two or more monomers; the copolymers of the present invention are polymers of three or more monomers. The term "polymerized units of acid" as used herein refers to units which may occur in the polymer chain as the result of polymerizing the monoethylenically unsaturated mono- or dicarboxylic acids, however one skilled in the art will recognize that identical units may occur in the polymer chain as the result of polymerizing the corresponding anhydride, and therefore the term refers to polymers containing units derived from polymerizing either the monoethylenically unsaturated mono- or dicarboxylic acid, or the corresponding anhydride.

The term "lower alkyl" as used herein refers to a linear or branched alkyl group containing from one to eight carbon atoms. The terms "(meth)acrylate" and "(meth)acrylic" as used herein mean acrylate, methacrylate or both acrylate and methacrylate; and acrylic, methacrylic or both acrylic and methacrylic. The term "unsubstituted" as used herein with respect to the lower alkyl group means that the lower alkyl group is not substituted with a functional group such as a hydroxyl group; it does not exclude the presence of a hydrocarbon branch.

The polymeric additive compositions of the present invention are copolymers comprising from 50 to 85 mol percent polymerized units of one or more monoethylenically unsaturated $C_3$ to $C_6$ monocarboxylic acids, from 5 to 50 mol percent polymerized units of one or more monoethylenically unsaturated $C_4$ to $C_6$ dicarboxylic acids, and from 10 to 40 mol percent polymerized units of one or more lower-alkyl esters of (meth)acrylic acid, the lower-alkyl groups being unsubstituted and the copolymer having a weight-average molecular weight of from 1000 to 30,000. As indicated above, the polymeric additive compositions may be made by copolymerizing the mono- and dicarboxylic acids, the corresponding acid anhydrides, or mixtures of the corresponding acids and acid anhydrides.

A preferred range for the polymerized units of one or more monoethylenically unsaturated $C_4$ to $C_6$ dicarboxylic acids is from 5 to 30 mol percent, more preferably from 10 to 20 mol percent. A preferred range for the polymerized units of one or more lower-alkyl esters of (meth)acrylic acid is from 10 to 30 mol percent, more preferably 15 to 25 mol percent. The combined dicarboxylic acid units and units of alkyl esters of (meth)acrylic acid total at most 60 mol percent of the polymer, as the minimum amount of monoethylenically unsaturated $C_3$ to $C_6$ monocarboxylic acids is 40 mol percent. A preferred range for the weight-average molecular weight of the copolymer is from 2000 to 15,000, more preferably from 3500 to 10,000.

The alcohol component of the lower-alkyl ester of (meth) acrylic acid is preferably methanol, ethanol, propanol or butanol, and may be linear or branched, and further may be a diol, such as ethanediol, 1,2-propanediol, 1,3-propanediol, 1,2-butanediol, 1,3-butanediol and 1,4-butanediol, resulting in an ester substituted with a single hydroxyl group on the alcohol component. The unsubstituted lower-alkyl ester of (meth)acrylic acid is more preferably selected from the group consisting of methyl acrylate, ethyl acrylate, n-propyl acrylate, sec-propyl acrylate, n-butyl acrylate, iso-butyl acrylate, 1-methylpropyl acrylate and 2-methylpropyl acrylate, and the corresponding methacrylates, and is still more preferably selected from the group consisting of methyl acrylate, methyl methacrylate, ethyl acrylate and ethyl methacrylate. Examples of the lower-alkyl ester of (meth)acrylic acid substituted with a hydroxyl group, which are useful in the present invention, are hydroxyethyl acrylate and methacrylate, hydroxypropyl acrylate and methacrylate and hydroxybutyl acrylate and methacrylate.

In those cases where the lower-alkyl group is substituted with a hydroxyl group, the polymerization of the copolymer is conducted at pH 2.0 or less. The polymerization of the copolymer is preferably also conducted at pH 2.0 or less where the lower-alkyl group is unsubstituted. Thus while the mono- and dicarboxylic acids may be partially neutralized when preparing the copolymer containing unsubstituted lower-alkyl esters of (meth)acrylic acid, it is preferred that any such neutralization of the acids be limited to avoid raising the pH above 2.0 when preparing the copolymer containing lower-alkyl esters of methacrylic or acrylic acid in which the lower-alkyl group is substituted with a hydroxyl group.

It is preferred that the polymeric additives of the present invention be soluble in aqueous solutions over the entire pH range encountered during preparation of the polymeric additive, storage of the ADD composition, whether liquid or solid, containing the polymeric additive, and use of the polymeric additive in automatic dishwashers, i.e., over a pH range of from 5 to 12. This solubility preference sets upper limits for the preferred range of the polymerized units of lower alkyl esters of acrylic and methacrylic acid, depending upon the solubility of the polymer containing those polymerized units. Thus while the range of polymerized units of lower alkyl esters of (meth)acrylic acid is from 10 to 40 mol percent, the level of a particular ester should preferably not render the polymeric additive insoluble during preparation, storage or use in automatic dishwashers. Polymerized units of unsubstituted esters of alcohols higher than ethanol are, therefore, preferably limited to the range of 0 to 30 mol percent, more preferably 0 to 15 mol percent, and still more preferably 0 to 10 mol percent, of the total polymer.

A surprising feature of the polymeric additives of the present invention is that they are stable at the high pH levels encountered when they are used in automatic dishwashers. It would be reasonable for one having ordinary skill in the art to expect polymerized units of esters to hydrolyze in the strongly basic environment created by such ADD composition components as sodium carbonate. It is clear that the ester units of the polymeric additive are not hydrolyzing to a significant extent, because the result would be a polymeric additive containing polymerized units identical to those of polymerized (meth)acrylic acid, and the performance testing of the polymeric additives of the present invention show them to be superior to copolymers of, for example, maleic and acrylic acids.

The examples below exemplify one method of making the polymeric compositions of the present invention; other methods of making the polymeric compositions will be apparent to those having ordinary skill in the art, in view of the present disclosure. The polymeric compositions of the present invention may be made by aqueous polymerization, solvent polymerization or bulk polymerization. Further, the polymerization may be conducted as a batch, co-feed, heel, semi-continuous or continuous process. Preferably the polymerization is conducted as a co-feed process. When the process of the present invention is conducted as a co-feed process, the initiator and monomers are preferably introduced into the reaction mixture as separate streams and at a constant rate. If desired, the streams may be introduced so that addition of one or more of the streams is completed before the others. If desired, a portion of the monomers or initiator may be added to the reactor before the feeds are begun. The monomers may be fed into the reaction mixture as individual streams or combined into one or more streams.

The weight-average molecular weight of the polymeric additive composition is from 1000 to 30,000. The molecular weight will vary depending upon the relative amounts, and the hydrophilicity, of the monomer components incorporated into the copolymer. If desired, chain regulators or chain-transfer agents may be employed during the polymerization to assist in controlling the molecular weight of the resulting polymers. Any conventional water-soluble chain regulators or chain-transfer agents may be used. Suitable chain regulators include, but are not limited to, mercaptans such as 2-mercaptoethanol and 3-mercaptopropionic acid, hypophosphites, isoascorbic acid, alcohols, aldehydes, hydrosulfites and bisulfites. Preferred as chain regulators or chain-transfer agents are bisulfites such as sodium metabisulfite. Weight-average and number-average molecular weights as set forth herein are as measured by aqueous gel permeation chromatography relative to a poly(acrylic acid) standard having a molecular weight of 4500.

The automatic dishwashing detergent compositions using the polymeric additive of the present invention may be in the form of a powder or a liquid; as used herein in reference to the ADD composition, the term "liquid" includes gels and slurries. The ADD composition of the present invention may also comprise ADD components known to those skilled in the art, such as detergency builders, corrosion inhibitors, surfactants, bleaches, bleach activators, detersive enzymes, dyes, fragrances, and inert diluents such as water and water-soluble, inorganic alkali-metal salts. The polymeric additive of the present invention is present in an amount of from 1 to 20 weight percent, preferably from 2 to 10 weight percent, based upon the total weight of the ADD composition.

Among the detergency builders useful in the ADD compositions of the present invention are alkali-metal carbonates, borates, bicarbonates and hydroxides; water-soluble organic builders which include polycarboxylic materials such as nitrilotriacetic acid, citrates, tartrates and succinates; and zeolites. While phosphate-containing builders such as sodium tripolyphosphate and sodium pyrophosphate may be used with the polymeric detergent additives of the present invention, these are not preferred, and the resulting ADD compositions are not phosphate-free. The builders may be present in the ADD compositions at levels from 0 to 90% by weight, preferably from 20 to 90% by weight, based on the total weight of the ADD composition. The actual builder amount is dependent upon whether the detergent is a liquid or a powder; generally a liquid composition will contain less builder than a powder composition.

Among the corrosion inhibitors useful in the ADD compositions of the present invention are alkali-metal silicates, preferably those having an $SiO_2$:$M_2O$ ratio (where $M_2O$ represents the alkali metal oxide portion of the silicate) of from 1:1 to 3.5:1. An example of preferred alkali-metal silicates are the sodium silicates. The corrosion inhibitor may be present in the ADD composition at levels from 0 to 50% by weight, preferably from 1 to 20% by weight, based on the total weight of the ADD composition.

Among the surfactants useful in the ADD compositions of the present invention are low-foaming, water-soluble surfactants such as anionic, nonionic, zwitterionic and amphoteric surfactants, and combinations thereof. Examples of anionic surfactants useful in the ADD compositions of the present invention are salts of fatty acids containing from 9 to 20 carbon atoms, alkylbenzene sulfonates, and particularly linear alkylbenzene sulfonates, in which the alkyl group contains from 10 to 16 carbon atoms, alcohol sulfates, ethoxylated alcohol sulfates, hydroxyalkyl sulfonates, alkenyl and alkyl sulfates and sulfonates, monoglyceride sulfates, acid condensates of fatty acid chlorides with hydroxyalkyl sulfonates and the like. Because anionic surfactants tend to produce foam, their levels in the ADD compositions should be kept to a minimum, and foam suppressants may be required.

Examples of nonionic surfactants useful in the ADD compositions of the present invention are alkylene oxide (e.g., ethylene oxide) condensates of mono- and polyhydroxy alcohols, alkylphenols, fatty acid amides, and fatty amines, amine oxides, sugar derivatives such as sucrose monopalmitate, dialkyl sulfoxides, block copolymers of poly(ethylene oxide) and poly(propylene oxide), hydrophobically modified poly(ethylene oxide) surfactants, fatty acid amides, for example mono- or diethanolamides of $C_{10}$–$C_{18}$ fatty acids, and the like.

Examples of zwitterionic surfactants useful in the ADD compositions of the present invention include derivatives of aliphatic quaternary ammonium compounds such as 3-(N,N-dimethyl-N-hexadecylammonio)propane-1-sulfonate and 3-(N,N-dimethyl-N-hexadecylammonio)-2-hydroxypropane-1-sulfonate. Examples of amphoteric surfactants useful in the ADD compositions of the present invention include betaines, sulfobetaines and fatty acid imidazole carboxylates and sulfonates.

The total level of surfactant present in the ADD compositions of the present invention will depend on the surfactant chosen, and is preferably from 0.1 to 10% by weight, more preferably from 1 to 5% by weight, based upon the total weight of the ADD composition. Anionic surfactants, if used, are preferably present at levels below 5% by weight, preferably below 3% by weight, based on the total weight of the ADD composition.

Bleaches useful in the ADD compositions of the present invention include halogen, peroxide and peracid bleaches such as sodium chlorite, sodium hypochlorite, sodium dichloroisocyanurate, sodium perborate and sodium percarbonate, and the corresponding potassium salts. The bleaches may be present at levels of from 0 to 20% by weight, preferably from 0.5 to 15% by weight, based on the total weight of the ADD composition. Bleach activators may be included in the ADD compositions of the present invention; such bleach activators are chosen to optimize bleaching at low temperatures, and include such materials as N,N,N',N'-tetraacetylethylene diamine (TAED), sodium nonyloxybenzene sulfonate (SNOBS), glucose pentaacetate (GPA) and tetraacetyl glycouril (TAGU). Selection of the bleach activator appropriate to the bleach chosen is within the capability of one having ordinary skill in the art.

The ADD composition of the present invention may also include up to 5% by weight of conventional adjuvants such as fragrances, dyes, foam suppressants, detersive enzymes such as proteolytic enzymes and amylases, antibacterial agents and the like. When the detergent is in the liquid form, from 0 to 5% by weight, based on the total weight of the ADD composition, of stabilizers or viscosity modifiers, such as clays and polymeric thickeners, may be present. Additionally, inert diluents, as for example inorganic salts such as sodium or potassium sulfate or chloride, and water may be present.

The components selected for the ADD composition are preferably compatible with one another. For example, dyes, fragrances and enzymes are preferably compatible with bleach components and alkaline components, both during storage and under use conditions. It is within the ability of one having ordinary skill in the art to select components of the ADD compositions that are compatible with one another.

The ADD compositions of the present invention may be used in automatic dishwashers as an aqueous solution or dispersion at a concentration of from 0.1 to 1.0% by weight, preferably from 0.2 to 0.7% by weight, based on the total weight of liquid in the dishwasher. Concentrations higher or lower than these may also be used, but lower concentrations may result in inadequate cleaning under specific circumstances, and higher concentrations do not provide improved cleaning results that offset the increased cost. The water temperature during the washing process is preferably from 35° C. to 70° C., more preferably from 40° C. to 60° C.

In the following examples, all reagents used are of good commercial quality unless otherwise indicated, and all percentages and ratios given herein are by weight unless otherwise indicated.

EXAMPLE 1

This example illustrates preparation of a polymeric additive of the present invention, containing 60 weight percent polymerized units of acrylic acid, 20 weight percent polymerized units of maleic acid and 20 weight percent polymerized units of ethyl acrylate.

To a 2-liter, 4-necked, round-bottom flask equipped with a mechanical stirrer, reflux condenser and thermocouple were added 337.2 grams deionized water, 64.8 grams maleic anhydride, 1.6 grams sodium metabisulfite, and 10.0 grams of a metal promoter solution of 0.15 weight percent ferrous sulfate in deionized water, to form a reaction mixture. The reaction mixture was heated to 72° C. after which the following four separate feeds were started simultaneously:

1) 242.5 grams glacial acrylic acid,
2) 81.7 grams ethyl acrylate,
3) a sodium metabisulfite feed solution of 36.3 grams sodium metabisulfite in 103.7 grams deionized water,
4) an initiator solution of 12.97 grams sodium persulfate in 105.3 grams deionized water.

The entire sodium metabisulfite feed solution was fed over a period of 75 minutes and the entire glacial acrylic acid, ethyl acrylate, and initiator solutions were fed over a period of 90 minutes.

After the feeds were completed, the reaction mixture was held at 72° C. for 15 minutes. Two separate solutions, one consisting of 0.13 grams sodium metabisulfite in 1.0 grams of deionized water and the other consisting of 0.13 grams sodium persulfate in 1.0 grams of deionized water, were prepared and added consecutively to the reaction mixture as monomer chases, the second chase being added after the reaction mixture was held at 72° C. for 15 minutes The reaction mixture was held at 72° C. for an additional 15 minutes before being cooled to 43° C.

When the temperature reached 43° C. a 5.0 gram portion of 30% hydrogen peroxide solution was added, and the reaction was further cooled to 25° C., at which point an additional 5.3 grams of 30% hydrogen peroxide solution was added.

The reaction mixture was neutralized to pH 7.0 by slow addition of 345.5 grams 50% aqueous sodium hydroxide, while maintaining the temperature below 25° C.

The resulting polymer product was a solution containing 41.5% solids by weight. The weight-average molecular weight was 3890, the number-average molecular weight was 3080, and the ratio of weight-average molecular weight to number-average molecular weight was 1.26.

EXAMPLE 2

This example illustrates preparation of a polymeric ADD additive of the present invention, containing 60 weight percent polymerized units of acrylic acid, 20 weight percent polymerized units of maleic acid and 20 weight percent polymerized units of ethyl acrylate, prepared using a different procedure which results in a different molecular weight.

To the equipment described in Example 1 were added 342.8 grams deionized water, 65.8 grams maleic anhydride, 0.8 grams sodium metabisulfite, and 10.2 grams of a metal promoter solution of 0.15 weight percent ferrous sulfate in deionized water to form a reaction mixture. The reaction mixture was heated to 72° C. after which the following four separate feeds were started simultaneously:

1) 246.2 grams of glacial acrylic acid,
2) 82.9 grams of ethyl acrylate,
3) a sodium metabisulfite feed solution of 19.7 grams sodium metabisulfite in 105.3 grams deionized water,
4) an initiator solution of 9.24 grams sodium persulfate in 105.3 grams deionized water.

The entire sodium metabisulfite feed solution was fed over a period of 75 minutes and the entire glacial acrylic acid, ethyl acrylate, and initiator solutions were fed over a period of 90 minutes.

After the feeds were completed, the reaction mixture was held at 72° C. for 15 minutes. Two separate solutions, one consisting of 0.5 grams sodium metabisulfite in 2.6 grams deionized water and the other consisting of 0.5 grams sodium persulfate in 2.6 grams deionized water, were prepared and added consecutively to the reaction mixture as monomer chases. After being held at 72° C. for 15 minutes the monomer chase was repeated as described, and the reaction mixture was held at 72° C. for an additional 15 minutes before being cooled to 25° C.

The reaction mixture was neutralized to pH 7.0 by slow addition of 356.3 grams of 50% sodium hydroxide, maintaining the temperature below 25° C.

The resulting polymer product was a solution containing 40.31 percent solids by weight. The weight-average molecular weight was 6790, the number-average molecular weight was 4960, and the ratio of weight-average molecular weight to number-average molecular weight was 1.37.

EXAMPLE 3

This example illustrates preparation of a polymeric ADD additive of the present invention, containing 50 weight percent polymerized units of acrylic acid, 19 weight percent polymerized units of maleic acid and 31 weight percent polymerized units of hydroxyethyl acrylate.

To a 1-liter, 4-necked, round-bottom flask equipped as described in Example 1 were added 110.80 grams deionized water, 26.91 grams maleic anhydride, 0.19 grams sodium metabisulfite, and 3.69 grams of a metal promoter solution of 0.15 weight percent ferrous sulfate in deionized water, to form a reaction mixture. The reaction mixture was heated to 72° C. after which the following four separate feeds were started simultaneously:

1) 71.76 grams glacial acrylic acid,
2) 44.85 grams hydroxyethyl acrylate,
3) a sodium metabisulfite feed solution of 7.23 grams sodium metabisulfite and 56.51 grams deionized water,
4) an initiator solution of 8.61 grams sodium persulfate in 50.93 grams deionized water.

The entire sodium metabisulfite feed solution was fed over a period of 75 minutes and the entire glacial acrylic acid, hydroxyethyl acrylate, and initiator solutions were fed over a period of 90 minutes.

After the feeds were completed, the reaction mixture was held at 72° C. for 15 minutes. Two separate solutions, each consisting of 0.05 grams sodium persulfate in 1.00 grams of water, were prepared and added consecutively to the reaction mixture as monomer chases, the second chase being added after the reaction mixture was held at 72° C. for 15 minutes. The reaction mixture was held at 72° C. for an additional 15 minutes and then cooled to 22° C.

The reaction mixture was neutralized from an initial pH 1.2 at 22° C. to pH 7.0 at 25° C. by slow addition of 118.0 grams 50% aqueous sodium hydroxide, while maintaining the temperature below 25° C.

The resulting polymer product solution was a solution containing 40.7% solids by weight. The weight-average molecular weight was 4800, the number-average molecular weight was 3820, and the ratio of weight-average molecular weight to number-average molecular weight was 1.25.

EXAMPLE 4

This example illustrates preparation of a polymeric ADD additive of the present invention, containing 60 weight percent polymerized units of acrylic acid, 20 weight percent polymerized units of maleic acid and 20 weight percent polymerized units of ethyl acrylate, prepared using a different procedure which results in a different molecular weight.

To a 1-liter flask equipped as described in Example 1 were added 175.2 grams deionized water, 33.7 grams maleic anhydride, 0.2 grams sodium metabisulfite, and 5.2 grams of a metal promoter solution of 0.15 weight percent ferrous sulfate in deionized water to form a reaction mixture. The reaction mixture was heated to 72° C. after which the following four separate feeds were started simultaneously:

1) 126.0 grams of glacial acrylic acid,
2) 42.5 grams of ethyl acrylate,
3) a sodium metabisulfite feed solution of 5.2 grams sodium metabisulfite in 53.9 grams deionized water,
4) an initiator solution of 1.86 grams sodium persulfate in 53.9 grams deionized water. The entire sodium metabisulfite feed solution was fed over a period of 75 minutes and the entire glacial acrylic acid, ethyl acrylate, and initiator solutions were fed over a period of 90 minutes.

After the feeds were completed, the reaction mixture was held at 72° C. for 15 minutes. Two separate solutions, one consisting of 0.1 grams sodium metabisulfite in 0.5 grams deionized water and the other consisting of 0.1 grams sodium persulfate in 0.5 grams deionized water, were prepared and added consecutively to the reaction mixture as monomer chases. After being held at 72° C. for 15 minutes the monomer chases were repeated as described, and the reaction mixture was held at 72° C. for an additional 15 minutes before being cooled to 25° C.

The reaction mixture was neutralized to pH 7.0 by slow addition of 169.7 grams 50% aqueous sodium hydroxide, maintaining the temperature below 25° C.

The resulting polymer product was a solution containing 40.0 percent solids by weight. The weight-average molecular weight was 21,300, the number-average molecular weight was 11,400, and the ratio of weight-average molecular weight to number-average molecular weight was 1.87.

EXAMPLE 5

This example illustrates preparation of a polymeric ADD additive of the present invention, containing 70 weight percent polymerized units of acrylic acid, 10 weight percent polymerized units of maleic acid and 20 weight percent polymerized units of ethyl acrylate, prepared using a procedure which results in a molecular weight similar to that of Example 1.

To the equipment described in Example 1 were added 336.5 grams deionized water, 33.8 grams maleic anhydride, 1.0 grams sodium metabisulfite, and 10.1 grams of a metal promoter solution of 0.15 weight percent ferrous sulfate in deionized water to form a reaction mixture. The reaction mixture was heated to 72° C. after which the following four separate feeds were started simultaneously:

1) 280.2 grams glacial acrylic acid,
2) 80.1 grams ethyl acrylate,
3) a sodium metabisulfite feed solution of 26.27 grams sodium metabisulfite in 105.1 grams deionized water,
4) an initiator solution of 10.5 grams sodium persulfate in 105.1 grams deionized water. The entire sodium metabisulfite feed solution was fed over a period of 75 minutes and the entire glacial acrylic acid, ethyl acrylate, and initiator solutions were fed over a period of 90 minutes.

After the feeds were completed, the reaction mixture was held at 72° C. for 15 minutes. Two separate solutions, one consisting of 0.5 grams sodium metabisulfite in 2.6 grams deionized water and the other consisting of 0.5 grams sodium persulfate in 2.6 grams deionized water, were prepared and added to the reaction mixture as monomer chases. After being held at 72° C. for 15 minutes the monomer chases were repeated as described, and the reaction mixture was held at 72° C. for an additional 15 minutes before being cooled to 25° C.

The reaction mixture was neutralized to pH 7.0 by slow addition of 348.6 grams 50% aqueous sodium hydroxide, maintaining the temperature below 25° C.

The resulting polymer product was a solution containing 42.1 percent solids by weight. The weight-average molecular weight was 4700, the number-average molecular weight was 3590, and the ratio of weight-average molecular weight to number-average molecular weight was 1.31.

EXAMPLE 6

This example illustrates preparation of a polymeric ADD additive of the present invention, containing 70 weight percent polymerized units of acrylic acid, 19 weight percent polymerized units of maleic acid and 11 weight percent polymerized units of hydroxyethyl acrylate.

To a 1-liter flask equipped as described in Example 1 were added 110.80 grams deionized water, 26.91 grams maleic anhydride, 0.19 grams sodium metabisulfite, and 3.69 grams of a metal promoter solution of 0.15 weight percent ferrous sulfate in deionized water to form a reaction mixture. The reaction mixture was heated to 72° C., after which the following four separate feeds were started simultaneously:

1) 100.46 grams glacial acrylic acid,
2) 16.15 grams hydroxyethyl acrylate,
3) a sodium metabisulfite feed solution of 7.23 grams sodium metabisulfite and 56.51 grams of deionized water,
4) an initiator solution of 8.61 grams of sodium persulfate in 50.93 grams of deionized water.

The entire sodium metabisulfite feed solution was fed over a period of 75 minutes and the entire glacial acrylic acid, hydroxyethyl acrylate, and initiator solutions were fed over a period of 90 minutes.

After the feeds were completed, the reaction mixture was held at 72° C. for 15 minutes. Two separate solutions, each consisting of 0.05 grams sodium persulfate in 1.00 grams water were prepared and added to the reaction mixture as monomer chases, the second being added after the reaction mixture was held at 72° C. for 15 minutes. The reaction mixture held at 72° C. for an additional 15 minutes before being cooled to 23° C.

The reaction mixture was neutralized from an initial pH 1.1 at 23° C. to pH 7.0 at 25° C. by slow addition of 144.9 grams of 50% aqueous sodium hydroxide, while maintaining the temperature below 25° C.

The resulting polymer product solution was a solution containing 40.5 percent solids by weight. The weight-average molecular weight was 4650. the number-average molecular weight was 3790, and the ratio of weight-average molecular weight to number-average molecular weight was 1.22.

EXAMPLE 7

This example illustrates preparation of a polymeric ADD additive of the present invention, containing 50 weight percent polymerized units of acrylic acid, 30 weight percent polymerized units of maleic acid and 20 weight percent polymerized units of hydroxypropyl acrylate.

To a ½ liter, 4-neck flask equipped as described in Example 1 was added 75.00 grams deionized water, 6.00 grams of a 0.15-weight-percent aqueous solution of $FeSO_4.7H_2O$, 60.00 grams maleic acid and 21.00 grams of a 50 weight percent aqueous solution of sodium hydroxide to form a reaction mixture. The reaction mixture was heated to 72°–73° C. with stirring, separate feeds, begun simultaneously, of 4.00 grams sodium persulfate in 20.00 grams deionized water and 40.00 grams hydroxypropyl acrylate in 100.00 grams glacial acrylic acid were added over a period of 120 minutes, and a separate feed, begun concurrently with the other two feeds, of 12.00 grams sodium metabisulfite in 45.00 grams deionized water was added over a period of 100 minutes. After the feeds were complete the pH of the reaction mixture was measured and found to be pH 1.8. The reaction mixture was held at 72°–73° C. for 10 minutes, and a solution of 0.20 grams sodium persulfate in 3.00 grams deionized water was added. The reaction mixture was stirred, and another solution containing 0.20 grams sodium persulfate in 3.00 grams deionized water was added. The reaction mixture was cooled to 45° C.; 20.80 grams of 50-weight-percent aqueous sodium hydroxide was added, and the mixture was treated with 1.30 grams of 30–33% hydrogen peroxide solution. The pH was increased to 6.7 by adding 131.10 grams of 50-weight-percent aqueous sodium hydroxide and the mixture was diluted by adding 30.00 grams deionized water.

The resulting solution polymer had a solids content of 46.7%, a weight-average molecular weight of 5,340 and a number-average molecular weight of 4000. The residual acrylic and maleic acid monomer contents were 194 and 2200 parts per million, respectively.

EXAMPLE 8

This example illustrates preparation of a polymeric ADD additive of the present invention, containing 60 weight percent polymerized units of acrylic acid, 20 weight percent polymerized units of maleic acid and 20 weight percent polymerized units of methyl methacrylate.

To a 1 Liter flask equipped as described in Example 1 were added 130.0 grams deionized water, 25.0 grams maleic anhydride, 0.4 grams sodium metabisulfite, and 3.9 grams of a metal promoter solution of 0.15 weight percent ferrous sulfate in deionized water to form a reaction mixture. The reaction mixture was heated to 72° C. after which the following four separate feeds were started simultaneously:

1) 93.5 grams glacial acrylic acid,
2) 31.5 grams methyl methacrylate,
3) a sodium metabisulfite feed solution of 10.0 grams sodium metabisulfite in 40.0 grams deionized water,
4) an initiator solution of 4.0 grams sodium persulfate in 40.0 grams deionized water.

The entire sodium metabisulfite feed solution was fed over a period of 75 minutes and the entire glacial acrylic acid, methyl acrylate, and initiator solutions were fed over a period of 90 minutes.

After the feeds were completed, the reaction mixture was held at 72° C. for 15 minutes. A solution consisting of 0.05 grams sodium persulfate in 1.0 grams deionized water was prepared and added to the reaction mixture as a monomer chase. After being held at 72° C. for 15 minutes the monomer chase was repeated as described, and the reaction mixture was held at 72° C. for an additional 15 minutes before being cooled to 25° C.

The reaction mixture was neutralized to pH 7.0 by slow addition of 130.9 grams 50% aqueous sodium hydroxide, maintaining the temperature below 25° C.

The resulting polymer product was a solution containing 41.7 percent solids by weight. The weight-average molecular weight was 7220, the number-average molecular weight was 5080, and the ratio of weight-average molecular weight to number-average molecular weight was 1.42.

EXAMPLE 9

This example illustrates preparation of a polymeric ADD additive of the present invention, containing 40 weight percent polymerized units of acrylic acid, 40 weight percent polymerized units of maleic acid and 20 weight percent polymerized units of hydroxypropyl acrylate.

To a ½ liter, 4-neck flask equipped as described in Example 1 was added 80.00 grams deionized water, 3.00 grams of a 0.15-weight-percent aqueous $FeSO_4.7H_2O$ solution, 80.00 grams maleic acid and 82.75 grams of a 50-weight-percent sodium hydroxide solution to form a reaction mixture. The reaction mixture was heated to 92° C. with stirring, and 4.00 grams sodium hypophosphite in 20.00 grams of deionized water was added. Separate feeds, begun simultaneously, of 4.00 grams sodium persulfate in 20.00 grams deionized water and 40.00 grams hydroxypropyl acrylate in 80.00 grams glacial acrylic acid were added over a period of 120 minutes, and a separate feed, begun concurrently with the first two feeds, of 4.00 grams sodium hypophosphite in 20.00 grams deionized water was added over a period of 100 minutes. After the additions were completed the reaction mixture was held at 92° C. for 30 minutes. The reaction mixture was diluted with 47.00 grams of deionized water, cooled to 45° C. and the pH was adjusted to 6.8 by gradual addition of 92.70 grams 50-weight-percent sodium hydroxide solution.

The resulting solution polymer had a solids content of 46.5%, a weight-average molecular weight of 3,960, and a number-average molecular weight of 3,280. The residual acrylic and maleic acid monomer contents were 148 and 1200 parts per million, respectively.

EXAMPLE 10

Using the procedure described in Example 1, a polymeric ADD additive of the present invention was prepared containing 60 weight percent polymerized units of acrylic acid, 20 weight percent polymerized units of maleic acid and 20 weight percent polymerized units of methyl acrylate. The properties and performance of the resulting additive are shown in Table II, below.

EXAMPLE 11

Using the procedure described in Example 7, a polymeric ADD additive of the present invention was prepared containing 60 weight percent polymerized units of acrylic acid, 20 weight percent polymerized units of maleic acid and 20 weight percent polymerized units of hydroxybutyl acrylate. The properties and performance of the resulting additive are shown in Table II, below.

EXAMPLE 12

Using the procedure described in Example 1, a polymeric ADD additive of the present invention was prepared containing 60 weight percent polymerized units of acrylic acid, 20 weight percent polymerized units of maleic acid and 20 weight percent polymerized units of hydroxyethyl acrylate. The properties and performance of the resulting additive are shown in Table II, below.

EXAMPLE 13

Using the procedure described in Example 7, a polymeric ADD additive of the present invention was prepared containing 60 weight percent polymerized units of acrylic acid, 20 weight percent polymerized units of maleic acid, 15 weight percent polymerized units of hydroxypropyl acrylate and 5 weight percent polymerized units of butyl acrylate. The properties and performance of the resulting additive are shown in Table II, below.

EXAMPLE 14

Using the procedure described in Example 1, a polymeric ADD additive of the present invention was prepared containing 60 weight percent polymerized units of acrylic acid, 20 weight percent polymerized units of maleic acid and 20 weight percent polymerized units of hydroxypropyl acrylate. The properties and performance of the resulting additive are shown in Table II, below.

EXAMPLE 15

Using the procedure described in Example 7, a polymeric ADD additive of the present invention was prepared containing 70 weight percent polymerized units of acrylic acid, 10 weight percent polymerized units of maleic acid and 20 weight percent polymerized units of hydroxypropyl acrylate. The properties and performance of the resulting additive are shown in Table II, below.

To determine the effectiveness of the polymeric ADD additives of the above examples, and of comparative examples below, the ADD additives were incorporated into a typical ADD formulation shown in Table I, below containing the indicated ingredients and their amounts, so that their relative scale-inhibition properties might be evaluated.

TABLE 1

| Ingredient | Formulation I (% by wt.) |
|---|---|
| Sodium Citrate dihydrate | 10 |
| Sodium Carbonate | 30 |
| Britesil H2O[1] | 7 |
| Sodium Perborate tetrahydrate | 7.5 |
| TAED[2] | 2.5 |
| Protease[3] | 1 |
| Amylase[4] | 1 |
| Polytergent SLF-18[5] | 3 |
| Sodium Bicarbonate | 20 |
| Sodium Sulfate | 2 |
| Water | 10 |
| Polymeric Additive | 6 |

TABLE 1-continued

| Ingredient | Formulation I (% by wt.) |
|---|---|

[1]Britesil H2O is hydrous sodium polysilicate having a $SiO_2/Na_2O$ weight ratio of 2, obtained from PQ Corp., Valley Forge, PA.
[2]TAED is N,N,N,',N'-tetraacetylethylene diamine
[3]The protease used is Esperase 6.0T from Novo Nordisk Bioindustrials, Danbury, CT.
[4]The amylase used is Termamyl 60T from Novo Nordisk Bioindustrials, Danbury, CT.
[5]Polytergent SLF-18 is a nonionic ethoxylated alcohol obtained from Olin Corp.

The test method used to determine the filming and spotting performance, i.e., calcium scale-inhibition performance, of the ADD formulations was ASTM 3556–85, *Standard Test Method for Deposition on Glassware During Mechanical Dishwashing*, modified by using four 250-ml (10-ounce) Libbey Collins glasses and a Kenmore automatic dishwasher set to a normal wash cycle and heated dry cycle. (Kenmore is a trademark of Sears, Roebuck and Co.) The bottom rack of the dishwasher was randomly loaded with 14–18 dinner plates and the top rack was randomly loaded with several beakers and cups. The four Libbey Collins glasses were placed randomly on the top racks as the test glasses. The water temperature used in this test during the normal cycle was typically between 48.5° C. and 51.5° C. (119° F. and 124° F.), and the water contained 300 ppm hardness (as $CaCO_3$) with a Ca:Mg ratio of 3:1. No rinse aids or food soils were employed. A normal cycle consisted of a first wash, a rinse, main wash, and two more rinses, followed by a heated dry cycle. At the beginning of the test, a 25-g detergent sample was placed in the detergent dispenser cup. At the beginning of the main wash, the machine was opened and a second 25-g detergent aliquot was added. The glasses were washed for five complete cycles, and visually inspected for filming and spotting after the third and final cycles.

It should be noted that the conditions under which the above test was conducted are particularly harsh, in that a hardness level of 300 ppm $CaCO_3$ is greater than most of the world's potable waters. Thus the performance of the polymeric additives of the present invention is particularly good when used with very hard waters.

Performance results from the above test were recorded according to the following numerical values:

| Filming | Numerical Value |
|---|---|
| No Film | 0 |
| Barely Perceptible | 0.5 |
| Slight | 1 |
| Intermediate | 2 |
| Moderate | 3 |
| Heavy | 4 |
| Extreme | 4+ |

The results of testing the polycarboxylates of the present invention from Examples 1 through 15, according to the above test method, are shown in Table II, below. In Tables II and III, the columns headed Acrylic Acid, Maleic Acid and Ester Amount indicate the weight percentage of polymerized units of each polymer component, based upon the total polymer weight. The columns headed Mw and Mn indicate weight-average and number-average molecular weights, respectively.

TABLE II

| Example | Acrylic Acid | Maleic Acid | Ester Amount | Ester | Mw | Mn | Film[1] |
|---|---|---|---|---|---|---|---|
| 1 | 60 | 20 | 20 | EA | 3890 | 3080 | 0.7/0.8 |
| 2 | 60 | 20 | 20 | EA | 6790 | 4960 | 0.55 |
| 3 | 50 | 19 | 31 | HEA | 4800 | 3820 | 0.65 |
| 4 | 60 | 20 | 20 | EA | 21,300 | 11,400 | 1.3 (c) |
| 5 | 70 | 10 | 20 | EA | 4700 | 3590 | 0.65/0.70 |
| 6 | 70 | 19 | 11 | HEA | 4650 | 3790 | 1.1 (blue) |
| 7 | 50 | 30 | 20 | HPA | 5340 | 4000 | 0.5 |
| 8 | 60 | 20 | 20 | MMA | 7220 | 5060 | 0.5 |
| 9 | 40 | 40 | 20 | HPA | 3960 | 3280 | 0.85 |
| 10 | 60 | 20 | 20 | MA | 5500 | 4160 | 0.5 |
| 11 | 60 | 20 | 20 | HBA | 6220 | | 0.5 |
| 12 | 60 | 20 | 20 | HEA | 6910 | 4330 | 0.4 |
| 13 | 60 | 20 | 15/5 | HPA/BA | 5550 | | 0.6 |
| 14 | 60 | 20 | 20 | HPA | 5860 | 3710 | 0.35 |
| 15 | 70 | 10 | 20 | HPA | 4030 | | 0.5 |

[1]The extent of filming was determined at the end of 5 cycles.
Ester Identification:
BA = butyl acrylate
EA = ethyl acrylate
HBA = hydroxybutyl acrylate
HEA = hydroxyethyl acrylate
HPA = hydroxypropyl acrylate
MA = methyl acrylate
MMA = methyl methacrylate
Film:
(c) = chalky Comparative polycarobxcylate materials prepared by methods known to those skilled in the art were also evaluated according to the above test method. The comparative polycarboxylates are identified by example number, and the results of their evaluation are presented, in Table III below.

TABLE III

| Comparative Example | Acrylic Acid | Maleic Acid | Ester Amount | Ester | Mw | Film[1] |
|---|---|---|---|---|---|---|
| 16 | 100 | 0 | 0 | — | 2000 | 1.8/2.0 (blue) |
| 17 | 100 | 0 | 0 | — | 4500 | 1.1 |
| 18 | 100 | 0 | 0 | — | 10,000 | 0.9 |
| 19 | 100 | 0 | 0 | — | 40,000 | 2.0 (chalky) |
| 20 | 90 | 10 | 0 | — | 3200 | 1.5 |
| 21 | 80 | 20 | 0 | — | 4300 | 1.8 |
| 22 | 50 | 50 | 0 | — | 3500 | 1.5 |
| 23 | 30 | 70 | 0 | — | 4200 | 2.5[2] (chalky) |
| 24 | 80 | 0 | 20 | HEA | 3930 | 3.5 (chalky) |
| 25 | 80 | 0 | 20 | HPA | 4140 | 3.0[2] (chalky) |
| 26 | 80 | 0 | 20 | MMA | 4640 | 4 (chalky) |
| 27 | 80 | 0 | 20 | MA | 4060 | 4 (chalky) |
| 28 | 80 | 0 | 20 | HBA | 5180 | 2.5[2] (chalky) |
| 29 | 80 | 0 | 15/5 | HPA/BA | 4830 | 2.5 (chalky) |
| 30 | 80 | 0 | 20 | EA | 3950 | 3.5 (chalky) |
| 32 | 70 | 30[3] | 0 | — | 3500 | 1.9 |
| 33 | 70 | 30 | 0 | — | 30,000 | 1.2 |

[1]Except as noted, the extent of filming was determined at the end of 5 cycles.
[2]Filming was determined at the end of 3 cycles, because of excessive film formation.
[3]Not maleic acid but methacrylic acid.

COMPARATIVE EXAMPLE 31

As a further comparison of performance of the compositions of the present invention, the performance of the commercial product, Cascade® automatic dishwashing detergent, was evaluated by the above-described test for filming and spotting performance. Cascade is believed, based upon the disclosure of U.S. Pat. No. 5,279,756, to have the following composition:

TABLE IV

| Ingredient | Cascade Formulation |
|---|---|
| Sodium Tripolyphosphate | 33.0% |
| Sodium Carbonate | 21.0% |
| Nonionic Surfactant | 2.0% |

TABLE IV-continued

| Ingredient | Cascade Formulation |
|---|---|
| Sodium Silicate | 22.7% |
| ACL-59 (Chlorinating Agent) | 2.0% |
| Sodium Sulfate | 19.0% |
| Fragrance | 0.3% |

When evaluated according to the above-described test, the Cascade automatic dishwashing detergent scored a 0.8 for the extent of filming after 5 cycles, and the film had a blue color. Thus the compositions of the present invention performed generally as well as, and often better than, a typical, phosphate-containing, commercial ADD composition in preventing filming on washed glassware, under the conditions of this test.

PHOSPHORUS-CONTAINING ADD FORMULATIONS

To illustrate that the polymeric ADD additives of the present invention are effective in ADD formulations containing phosphates, in addition to those formulations containing no phosphorus, ADD formulations were prepared containing the ingredients and their amounts as shown in Table V, below. Formulation II is representative of a typical ADD concentrate (the so-called "Ultra") formulation containing a relatively large amount (35% by weight) of phosphate, and Formulation II is representative of a typical ADD concentrate containing a relatively small amount (20% by weight) of phosphate. The ingredients are as described in the footnotes to Table I, above.

TABLE V

| | Formulation II | | Formulation III | |
|---|---|---|---|---|
| Ingredient | Weight Percent | g/wash | Weight Percent | g/wash |
| Sodium Tripoly-phosphate | 35 | 12.6 | 20 | 7.20 |
| Sodium Citrate dihydrate | — | — | 10 | 3.60 |
| Sodium Carbonate | 22 | 7.92 | 30 | 10.8 |
| Britesil H20 | 12 | 4.32 | 12 | 4.32 |
| Sodium Perborate tetrahydrate | 7.5 | 2.7 | 7.5 | 2.7 |
| TAED | 2.5 | 0.90 | 2.5 | 0.90 |
| Protease | 1.0 | 0.36 | 1.0 | 0.36 |
| Amylase | 0.5 | 0.18 | 0.5 | 0.18 |
| Polytergent SLF-18 | 3.5 | 1.26 | 3.5 | 1.26 |
| Sodium Sulfate | 14 | 5.04 | 9 | 3.24 |
| Polymeric Additive | 2 | 0.72 | 4 | 1.44 |

The test method used to determine the filming and spotting performance of the formulations was that described in Example 15, above. Performance values from this test, for the two phosphate-containing formulations and the indicated polymeric additives, are shown in Table VI, below.

The following additional polymer compositions were tested in the phosphorus-containing ADD compositions of Formulations II and III.

EXAMPLES 32 AND 33

The polymeric additives of Examples 32 and 33 are comparative polymeric additives. The comparative additive of Example 32 contains 70 weight percent polymerized units of acrylic acid and 30 weight percent polymerized units of methacrylic acid, and has a weight-average molecular weight of 3500. The comparative additive of Example 33 contains 70 weight percent polymerized units of acrylic acid and 30 weight percent polymerized units of malaic acid, and has a weight-average molecular weight of 30,000. Results of testing these polymeric additives in phosphorus-free ADD compositions are shown above in Table III, and results of testing them in phosphorus-containing ADD compositions are shown below in Table VI.

EXAMPLE 34

This example illustrates preparation of a polymeric additive of the present invention, containing 60 weight percent polymerized units of acrylic acid, 20 weight percent polymerized units of maleic acid and 20 weight percent polymerized units of ethyl acrylate. The polymeric additive is similar to the additive of Examples 1 and 2, but the molecular weight (Mw) is intermediate between the additives of those two examples.

To the equipment described in Example 1 were added 342.8 g deionized water, 65.8 g maleic anhydride, 1.05 g sodium metabisulfite and 10.2 g of a promoter solution containing 0.15 weight percent ferrous sulfate in deionized water, to form a reaction mixture. The reaction mixture was heated to 72° C. and held at that temperature while the following four separate feeds were started simultaneously:

1) 246.2 g glacial acrylic acid,
2) 82.9 g ethyl acrylate,
3) a sodium metabisulfite feed solution of 26.1 g sodium metabisulfite in 105.3 g deionized water, and
4) an initiator solution of 9.24 g sodium persulfate in 105.3 g deionized water.

The sodium metabisulfite solution was fed to the reaction mixture over a period of 75 minutes and the acrylic acid, ethyl acrylate, and initiator solution were fed to the reaction mixture over a period of 90 minutes.

After the feeds were completed, the reaction mixture was held at 72° C. for 15 minutes. Two separate solutions, 0.5 g sodium metabisulfite in 2.6 g deionized water and 0.5 g sodium persulfate in 2.6 g deionized water, were prepared and added to the reaction mixture as monomer chase at the end of this 15-minute holding period. The reaction mixture was again held at 72° C. for 15 minutes, after which the monomer chase was repeated as described, and the reaction mixture was held an additional 15 minutes at 72° C. before being cooled to 25° C.

The reaction mixture was neutralized to pH 7.0 by slowly adding 358.8 g of 50% aqueous sodium hydroxide solution while maintaining the temperature below 25° C.

The solids content of the resulting polymer product solution was 40.55% by weight. The weight-average molecular weight (Mw) was 5480, the number-average molecular weight (Mn) was 4270, and the ratio of weight-average molecular weight to number-average molecular weight was 1.37. Results of testing the polymer product solution in phosphorus-containing ADD formulations are shown in Table VI, below.

EXAMPLE 35

This example illustrates preparation of a comparative polymeric additive containing 80 weight percent polymerized units of acrylic acid and 20 weight percent polymerized units of ethyl acrylate. The polymeric additive is similar to the additive of Example 30, but the molecular weight of the additive of this example is slightly higher.

To a 5-liter 4-necked, round-bottom flask equipped with a mechanical stirrer, a reflux condenser, and a thermocouple were added 996.8 g deionized water, 4.5 g sodium metabisulfite and 27.2 g of a promoter solution of 0.15% ferrous sulfate in deionized water, to form a reaction mixture. The reaction mixture was heated to 72° C. and held at that temperature while the following four separate feeds were started simultaneously:

1) 1087.4 g glacial acrylic acid,
2) 271.8 g ethyl acrylate,
3) a sodium metabisulfite feed solution of 77.0 g sodium metabisulfite in 317.1 g deionized water, and
4) an initiator solution of 17.8 g sodium persulfate in 181.2 g deionized water.

The sodium metabisulfite solution was fed to the reaction mixture over a period of 75 minutes and the glacial acrylic acid, ethyl acrylate, and initiator solutions were fed to the reaction mixture over a period of 90 minutes.

After the feeds were completed, the reaction mixture was held at 72° C. for 15 minutes. A solution of 0.5 g sodium persulfate in 9.0 g deionized water was prepared and added to the reaction mixture as monomer chase at the end of this 15-minute holding period. The reaction mixture was again held at 72° C. for 15 minutes, after which the monomer chase was repeated as described, and the reaction mixture was held an additional 15 minutes at 72° C. before being cooled to 25° C.

The reaction mixture was neutralized to pH 7.0 by slowly adding 1117.0 g of 50% aqueous sodium hydroxide solution while maintaining the temperature below 25° C.

The solids content of the resulting polymer product solution was 43.91% by weight. The weight-average molecular weight (Mw) was 4330, the number-average molecular weight fin) was 3560, and the ratio of weight-average molecular weight to number-average molecular weight was 1.22. Results of testing the polymer product solution in phosphorus-containing ADD formulations are shown in Table VI, below.

TABLE VI

| Example | Acrylic Acid | Maleic Acid | Ester Amount | Ester | Mw | Film Results, Formulation II | Film Results, Formulation III |
|---|---|---|---|---|---|---|---|
| 9 | 40 | 40 | 20 | HPA | 3960 | 1.45 | 1.15 |
| 14 | 60 | 20 | 20 | HPA | 5860 | 0.9 | 0.5 |
| 15 | 70 | 10 | 20 | HPA | 4030 | 0.9 | 0.7 |
| 17 | 100 | 0 | 0 | — | 4500 | 2 | 0.9 |
| 32 | 70 | 30[3] | 0 | — | 3500 | 1.0 | 1.1 |
| 33 | 70 | 30 | 0 | — | 30,000 | 1.8 | 0.7 |
| 34 | 60 | 20 | 20 | EA | 5480 | 0.6 | 0.3/0.5 |
| 35 | 80 | — | 20 | EA | 4330 | 0.8 (motley)[2] | 1.25 |
| Control[1] | — | — | — | — | — | 3 | 2.5 |

[1]The control is the phosphorus-containing formulation with no polymeric additive.
[2]The term motley, as used here, indicates a streaked, spotty film.
[3]Not maleic acid but methacrylic acid.

We claim:

1. A phosphorus-free automatic dishwashing detergent composition which comprises (a) from 1 to 20 weight percent of a copolymer comprising from 40 to 85 mol percent polymerized units of one or more monoethylenically unsaturated $C_3$ to $C_6$ monocarboxylic acids, from 5 to 50 mol percent polymerized units of one or more monoethylenically unsaturated $C_4$ to $C_6$ dicarboxylic acids, and from 10 to 40 mol percent polymerized units of one or more $C_1$ to $C_8$ esters of (meth)acrylic acid, the alkyl groups of said esters of (meth)acrylic acid being unsubstituted and the copolymer having a weight-average molecular weight of from 1000 to 30,000, and (b) one or more low-foaming, water-soluble surfactants present at a level of from 0.1 to 4 weight percent as the total level of surfactant present in the said composition.

2. The phosphorus-free automatic dishwashing detergent composition of claim 1, wherein the copolymer is present at a level of from 2 to 10 weight percent.

3. The phosphorus-free automatic dishwashing detergent composition of claim 1 wherein also a builder is present at a level of from 20 to 90 weight percent.

4. The phosphorus-free automatic dishwashing detergent composition of claim 1 wherein also an alkali-metal silicate having a $SiO_2$:$M_2O$ ratio of from 1:1 to 3.5:1 is present as a corrosion inhibitor at a level of from 1 to 20 weight percent.

5. The phosphorus-free automatic dishwashing detergent composition of claim 1 wherein the one or more surfactants include a nonionic surfactant.

6. A phosphorus-free automatic dishwashing detergent composition which comprises (a) from 1 to 20 weight percent of a copolymer comprising from 40 to 85 mol percent polymerized units of one or more monoethylenically unsaturated $C_3$ to $C_6$ monocarboxylic acids, from 5 to 50 mol percent polymerized units of one or more monoethylenically unsaturated $C_4$ to $C_6$ dicarboxylic acids, and from 10 to 40 mol percent polymerized units of one or more $C_1$ to $C_8$ esters of (meth)acrylic acid, at least one alkyl group of said esters of (meth)acrylic acid being substituted with a hydroxyl group, the copolymer having a weight-average molecular weight of from 1000 to 30,000, and the copolymer being polymerized at pH 2 or less, and (b) one or more low-foaming, water-soluble surfactants present at a level of from 0.1 to 4 weight percent as the total level of surfactant present in the said composition.

7. The phosphorus-free automatic dishwashing detergent composition of claim 6 wherein the copolymer is present at a level of from 2 to 10 weight percent.

8. The phosphorus-free automatic dishwashing detergent composition of claim 6 wherein also a builder is present at a level of from 20 to 90 weight percent.

9. The phosphorus-free automatic dishwashing detergent composition of claim 6 wherein also an alkali-metal silicate having a $SiO_2$:$M_2O$ ratio of from 1:1 to 3.5:1 is present as a corrosion inhibitor at a level of from 1 to 20 weight percent.

10. The phosphorus-free automatic dishwashing detergent composition of claim 6 wherein the one or more surfactants includes a nonionic surfactant.

11. A method for reducing film formation on tableware washed in an automatic dishwasher which comprises washing the tableware in the automatic dishwasher with an aqueous mixture of a phosphorus-free automatic-dishwashing detergent containing a copolymer comprising from 40 to 85 mol percent polymerized units of one or more monoethylenically unsaturated $C_3$ to $C_6$ monocarboxylic acids, from 5 to 50 mol percent polymerized units of one or more monoethylenically unsaturated $C_4$ to $C_6$ dicarboxylic acids, and from 10 to 40 mol percent polymerized units of one or more $C_1$ to $C_8$ esters of (meth)acrylic acid, the alkyl groups of said esters of (meth)acrylic acid being unsubstituted and the copolymer having a weight-average molecular weight of from 1000 to 30,000.

12. The method of claim 11 wherein the automatic-dishwashing detergent is present at a level of from 0.1 to 1.0 percent by weight, based upon the total weight of the aqueous mixture.

13. The method of claim 11 wherein the automatic-dishwashing detergent is present at a level of from 0.2 to 0.7 percent by weight, based upon the total weight of the aqueous mixture.

14. A method for reducing film formation on tableware washed in an automatic dishwasher which comprises washing the tableware in the automatic dishwasher with an aqueous mixture of a phosphorus-free automatic-dishwashing detergent containing a copolymer comprising from 40 to 85 mol percent polymerized units of one or more monoethylenically unsaturated $C_3$ to $C_6$ monocarboxylic acids, from 5 to 50 mol percent polymerized units of one or more monoethylenically unsaturated $C_4$ to $C_6$ dicarboxylic acids, and from 10 to 40 mol percent polymerized units of one or more $C_1$ to $C_8$ esters of (meth)acrylic acid, at least one alkyl group of said esters of (meth)acrylic acid being substituted with a hydroxyl group, the copolymer having a weight-average molecular weight of from 1000 to 30,000, and the copolymer being polymerized at pH 2 or less.

15. The method of claim 14 wherein the automatic-dishwashing detergent is present at a level of from 0.1 to 1.0 percent by weight, based upon the total weight of the aqueous mixture.

16. The method of claim 14 wherein the automatic-dishwashing detergent is present at a level of from 0.2 to 0.7 percent by weight, based upon the total weight of the aqueous mixture.

* * * * *